US010615490B2

(12) United States Patent
Lo et al.

(10) Patent No.: US 10,615,490 B2
(45) Date of Patent: Apr. 7, 2020

(54) WEARABLE DEVICE

(71) Applicant: Quanta Computer Inc., Taoyuan (TW)

(72) Inventors: Chung-Hung Lo, Taoyuan (TW); Chung-Ting Hung, Taoyuan (TW); Chin-Lung Tsai, Taoyuan (TW); Ching-Hai Chiang, Taoyuan (TW); Kuan-Hsien Lee, Taoyuan (TW); Ying-Cong Deng, Taoyuan (TW); Yi-Ling Tseng, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 65 days.

(21) Appl. No.: 16/041,901

(22) Filed: Jul. 23, 2018

(65) Prior Publication Data

US 2019/0356042 A1 Nov. 21, 2019

(30) Foreign Application Priority Data

May 16, 2018 (TW) ..... 107116579 A

(51) Int. Cl.
*H01Q 7/00* (2006.01)
*H01Q 1/48* (2006.01)
*H01Q 1/27* (2006.01)

(52) U.S. Cl.
CPC ..... *H01Q 1/273* (2013.01); *H01Q 1/27* (2013.01); *H01Q 1/48* (2013.01); *H01Q 7/00* (2013.01)

(58) Field of Classification Search
CPC ..... H01Q 1/273; H01Q 7/00; H01Q 1/48; H01Q 1/27
USPC ..... 343/718
See application file for complete search history.

(56) References Cited

U.S. PATENT DOCUMENTS 7,417,596 B2 * 8/2008 Zellweger ..... H01Q 1/273 343/702
2011/0013491 A1 1/2011 Fujisawa
2016/0156094 A1 * 6/2016 Lo ..... H01Q 1/273 343/702
2016/0294038 A1 * 10/2016 Lo ..... H01Q 1/48
2019/0067796 A1 * 2/2019 Lu ..... H01Q 5/392
2019/0109367 A1 * 4/2019 Tseng ..... H01Q 1/273

OTHER PUBLICATIONS

Chinese language office action dated Apr. 9, 2019, issued in application No. TW 107116579.

* cited by examiner

*Primary Examiner* — Hai V Tran
(74) *Attorney, Agent, or Firm* — McClure, Qualey & Rodack, LLP

(57) ABSTRACT

A wearable device worn by a user includes a base, an antenna structure, a ground plane, and a metal element. The base substantially has a hollow structure. The antenna structure is disposed on the base. The ground plane is disposed inside the base. The metal element is adjacent to the ground plane. The ground plane is positioned between the antenna structure and the metal element.

8 Claims, 4 Drawing Sheets

WEARABLE DEVICE

CROSS REFERENCE TO RELATED APPLICATIONS

This application claims priority of Taiwan Patent Application No. 107116579 filed on May 16, 2018, the entirety of which is incorporated by reference herein.

BACKGROUND OF THE INVENTION

Field of the Invention

The disclosure generally relates to a wearable device, and more specifically, to a wearable device including an antenna structure.

Description of the Related Art

With the progress being made in mobile communications technology, mobile devices such as portable computers, mobile phones, tablet computers, multimedia players, and other hybrid functional mobile devices have become common. To satisfy the demand of users, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

Researchers predict that the next generation of mobile devices will be "wearable devices". For example, wireless communication may be applied to watches, glasses, and even clothes in the future. However, watches, for example, do not have a large enough space to accommodate antennas for wireless communication. Accordingly, this has become a critical challenge for antenna designers.

BRIEF SUMMARY OF THE INVENTION

In a preferred embodiment, the disclosure is directed to a wearable device worn by a user. The wearable device includes a base, an antenna structure, a ground plane, and a metal element. The base substantially has a hollow structure. The antenna structure is disposed on the base. The ground plane is disposed inside the base. The metal element is disposed adjacent to the ground plane. The ground plane is positioned between the antenna structure and the metal element.

In some embodiments, the wearable device is implemented with a watch.

In some embodiments, the base is substantially a box without a lid, and the antenna structure is disposed at the open side of the box.

In some embodiments, the metal element is a metal plane.

In some embodiments, the metal element is a metal back cover disposed on the bottom of the base.

In some embodiments, the metal element is adjacent to the user, so as to prevent the user from interfering with the radiation performance of the antenna structure.

In some embodiments, the antenna structure is a metal loop.

In some embodiments, the wearable device further includes a transparent element surrounded by the metal loop.

In some embodiments, the vertical projection of the ground plane is completely inside the metal loop.

In some embodiments, the antenna structure is excited to generate a low-frequency band from 746 MHz to 787 MHz, and a high-frequency band from 1700 MHz to 2100 MHz.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
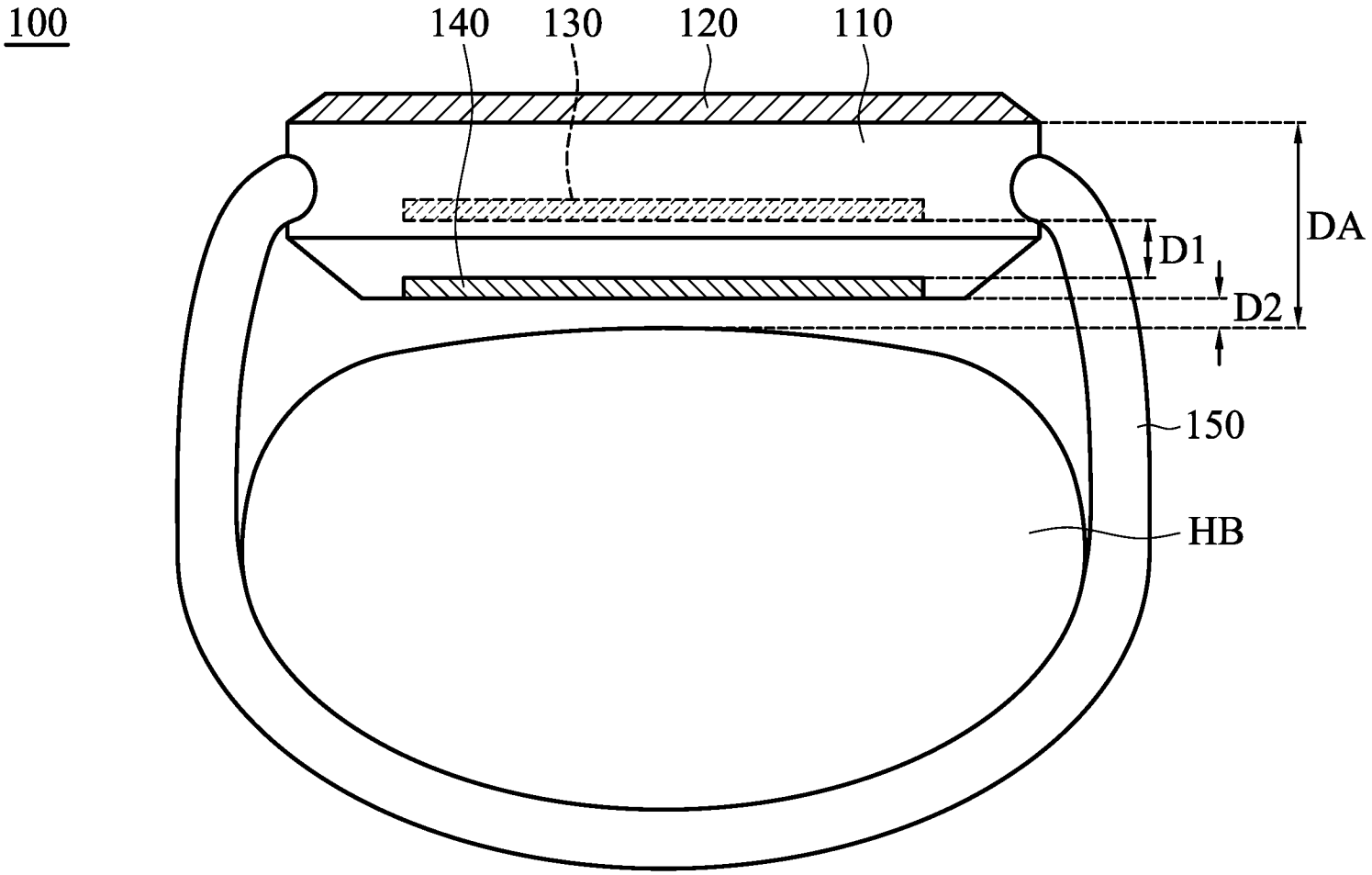
FIG. 1A is a side view of a wearable device according to an embodiment of the invention.
Figure 1B:
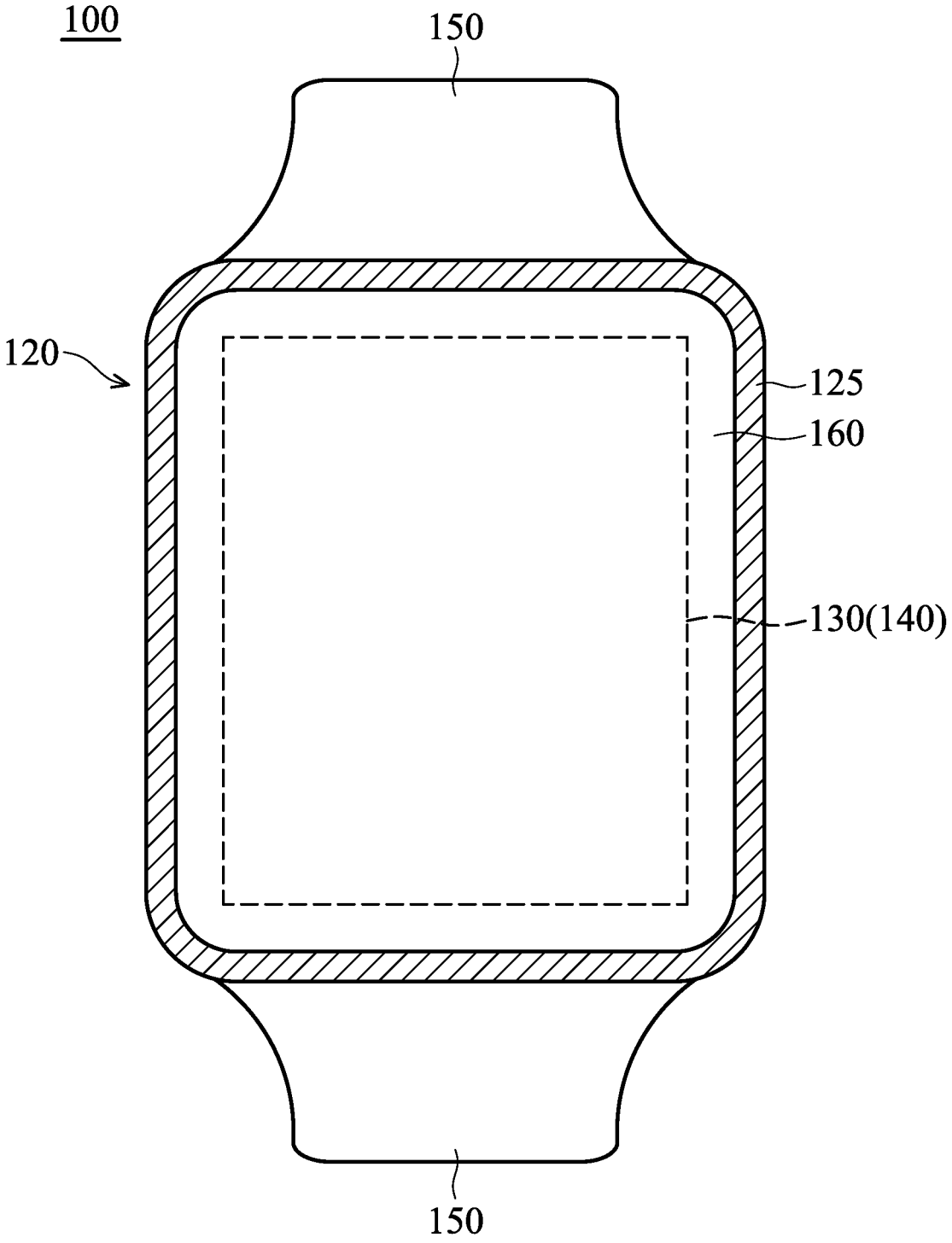
FIG. 1B is a top view of a wearable device according to an embodiment of the invention.

FIG. 1A is a side view of a wearable device 100 according to an embodiment of the invention. FIG. 1B is a top view of the wearable device 100 according to an embodiment of the invention. Please refer to FIG. 1A and FIG. 1B together. In a preferred embodiment, the wearable device 100 is a wrist-wearable device, such as a smart watch or a smart, sporty bracelet. As shown in FIG. 1A and FIG. 1B, the wearable device 100 at least includes a base 110, an antenna structure 120, a ground plane 130, and a metal element 140. The wearable device 100 may be worn by a user HB.

The base 110 may be made of a metal material or a plastic material. The base 110 substantially has a hollow structure. The shape, pattern, and surface treatment of the base 110 are not limited in the invention. The antenna structure 120 is disposed on the base 110. The antenna structure 120 may be made of a metal material. For example, the antenna structure 120 may be implemented with a metal loop 125, but the invention is not limited thereto. In other embodiments, adjustments are made such that the antenna structure 120 is replaced with a monopole antenna, a dipole antenna, a helical antenna, a patch antenna, a PIFA (Planar Inverted F Antenna), a chip antenna, or any other type antenna.

The ground plane 130 may be made of a metal material. The ground plane 130 is disposed inside the base 110, and it is configured to provide a ground voltage. In some embodiments, the wearable device 100 further includes a PCB (Printed Circuit Board) (not shown), and the ground plane 130 is disposed on the PCB. There may be other electronic components, such as a processor, a memory device, or a plurality of metal traces, disposed on the aforementioned PCB. In some embodiments, the vertical projection of the ground plane 130 is completely inside the metal loop 125 of the antenna structure 120.

The metal element 140 is disposed adjacent to the ground plane 130. The ground plane 130 is positioned between the antenna structure 120 and the metal element 140. It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0). For example, the metal element 140 may be directly coupled to the ground plane 130, or a coupling gap may be formed between the ground plane 130 and the metal element 140. In some embodiments, the metal element 140 is a metal plane disposed inside the base 110. In alternative embodiments, the metal element 140 is a metal back cover disposed on the bottom of the base 110. In other words, the metal element 140 may be an appearance decorative element of the wearable device 100. That is, the metal element 140 may be a portion on the wearable device 100, and such a portion can be directly observed by eyes of the user HB, so as improve the appearance consistency of the wearable device 100.

In some embodiments, the base 110 is substantially a box without a lid (e.g., a hollow cube without a lid to form a square opening), and the antenna structure 120 is disposed at the open side of the box. The base 110 can accommodate a variety of device components, such as a battery, an hour hand, a minute hand, a second hand, an RF (Radio Frequency) module, a signal processing module, a counter, a processor, a thermometer, and/or a barometer (not shown). In some embodiments, the metal loop 125 of the antenna structure 120 is substantially a square loop, and it may fit a square opening of the base 110. It should be understood that the wearable device 100 may further include other components, such as a time adjuster, a connection belt, a waterproof housing, and/or a buckle, although these components are not displayed in FIG. 1A and FIG. 1B.

Please refer to FIG. 1A and FIG. 1B again. The wearable device 100 may be implemented with a watch. With such a design, the wearable device 100 may further include a watchband 150 and a transparent element 160. For example, the transparent element 160 may be a watch surface glass or a transparent plastic board. The transparent element 160 may be disposed inside the metal loop 125 of the antenna structure 120, and it may be surrounded by the metal loop 125. Other watch components, such as an hour hand, a minute hand, and a second hand, may all be disposed under the transparent element 160 for the user HB to observe them. The watchband 150 may be connected to two opposite sides of the base 110, so that the user HB can wear the wearable device 100 on the wrist using the watchband 150.

When the user HB wears the wearable device 100, the metal element 140 may be close to the user HB (or the metal element 140 may directly touch the user EIB). It should be noted that the body of the user HB is considered as a conductive element. If the distance DA between the antenna structure 120 and the user HB is changed due to the movement of the user HB, the operation frequency and the radiation efficiency of the antenna structure 120 may be affected. With the design of the invention, after the metal element 140 is incorporated into the wearable device 100, the metal element 140 can be used as a shielding element for completely separating the body of the user HB from the antenna structure 120 and the ground plane 130. Therefore, the user HB does not negatively affect the radiation performance of the antenna structure 120. According to the practical measurement, the incorporation of the metal element 140 can enhance the radiation efficiency of the antenna structure 120 by about 3 dB, and therefore it can effectively improve the wireless communication quality of the wearable device 100.

In some embodiments, the element sizes of the wearable device 100 are as follows. The distance D1 between the ground plane 130 and the metal element 140 may be shorter than 5 mm. The distance D2 between the metal element 140 and the user HB may be shorter than 5 mm. The total area of the antenna structure 120 (including the central hollow portion) may be larger than or equal to the total area of the ground plane 130. The total area of the antenna structure 120 (including the central hollow portion) may be larger than or equal to the total area of the metal element 140. The total area of the ground plane 130 may be smaller than or equal to the total area of the metal element 140. The above ranges of element sizes are calculated and obtained according to many experiment results, and they help to optimize the shielding function of the metal element 140 and the radiation performance of the antenna structure 120.

In some embodiments, the antenna structure 120 is excited to generate a low-frequency band and a high-frequency band. The aforementioned low-frequency band may be from 746 MHz to 787 MHz, and the aforementioned high-frequency band may be from 1700 MHz to 2100 MHz. Accordingly, the antenna structure 120 can support at least the dual wideband operations of LTE (Long Term Evolution). However, the invention is not limited to the above. In other embodiments, the antenna structure 120 can support the dual wideband operations of WLAN (Wireless Local Area Network) 2.4 GHz/5 GHz.

The following embodiments will introduce a variety of configurations of the antenna structure 120. It should be understood that these figures and descriptions are merely exemplary, rather than limitations of the invention.

Figure 2:
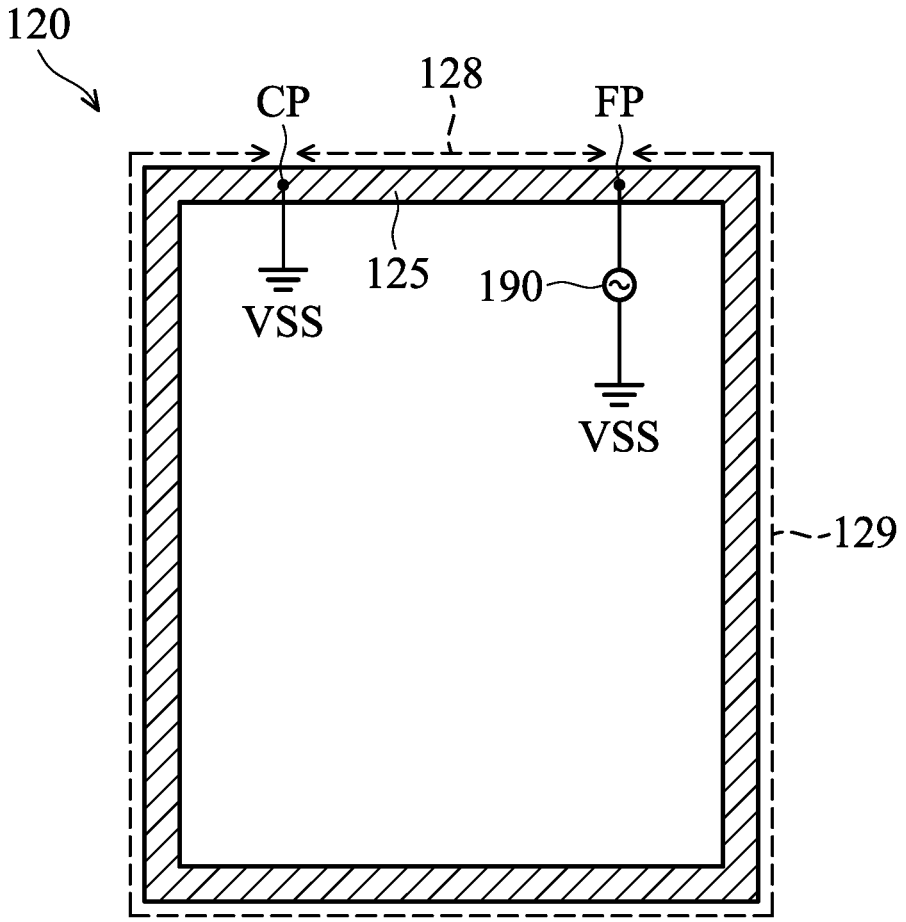
FIG. 2 is a top view of an antenna structure according to an embodiment of the invention.

FIG. 2 is a top view of an antenna structure 120 according to an embodiment of the invention. In the embodiment of FIG. 2, the antenna structure 120 includes a metal loop 125. The shape of the metal loop 125 is not limited in the invention. For example, the metal loop 125 may substantially have a square shape, a rectangular shape, a circular shape, an elliptical shape, a diamond shape, or a trapezoidal shape. The metal loop 125 has a feeding point FP and a grounding point CP. The feeding point FP may be coupled to a signal source 190, such as an RF module for exciting the antenna structure 120. The grounding point CP may be coupled to a ground voltage VSS, which may be provided by the ground plane 130. The positions of the feeding point FP and the grounding point CP are not limited in the invention. For example, the feeding point FP and the grounding point CP may be positioned at the same side of the metal loop 125, or the feeding point FP and the grounding point CP may be respectively positioned at two opposite sides of the metal loop 125. Alternatively, the feeding point FP and the grounding point CP may be respectively positioned at two opposite corners of the metal loop 125. In some embodiments, the feeding point FP of the metal loop 125 is coupled through a pogo pin or a metal spring (not shown) to the signal source 190, and the grounding point CP of the metal loop 125 is coupled through another pogo pin or another metal spring (not shown) to the ground plane 130.

Due to the shape characteristics of the metal loop 125, the antenna structure 120 has a first resonant path 128 and a second resonant path 129. The first resonant path 128 is a shorter portion of the path from the feeding point FP to the connection point CP of the metal loop 125. The second resonant path 129 is a longer portion of the path from the feeding point FP to the connection point CP of the metal loop 125. A combination of the first resonant path 128 and the second resonant path 129 can substantially cover the complete metal loop 125. With respect to the antenna theory, the low-frequency band of the antenna structure 120 is usually excited and generated by the longer second resonant path 129, and the high-frequency band of the antenna structure 120 is usually excited and generated by the shorter first resonant path 128. For example, the length of the first resonant path 128 may be substantially equal to 0.5 (λ12) wavelength of the high-frequency band of the antenna structure 120, and the length of the second resonant path 129 may be substantially equal to 0.5 (λ12) wavelength of the low-frequency band of the antenna structure 120. Therefore, the designer can appropriately change the positions of the feeding point FP and the connection point CP, so as to control the range of the operation frequency of the antenna structure 120. It should be noted that the metal loop 125 of the antenna structure 120 is usually applied to the base 110 made of a conductive material or a nonconductive material.

Figure 3:
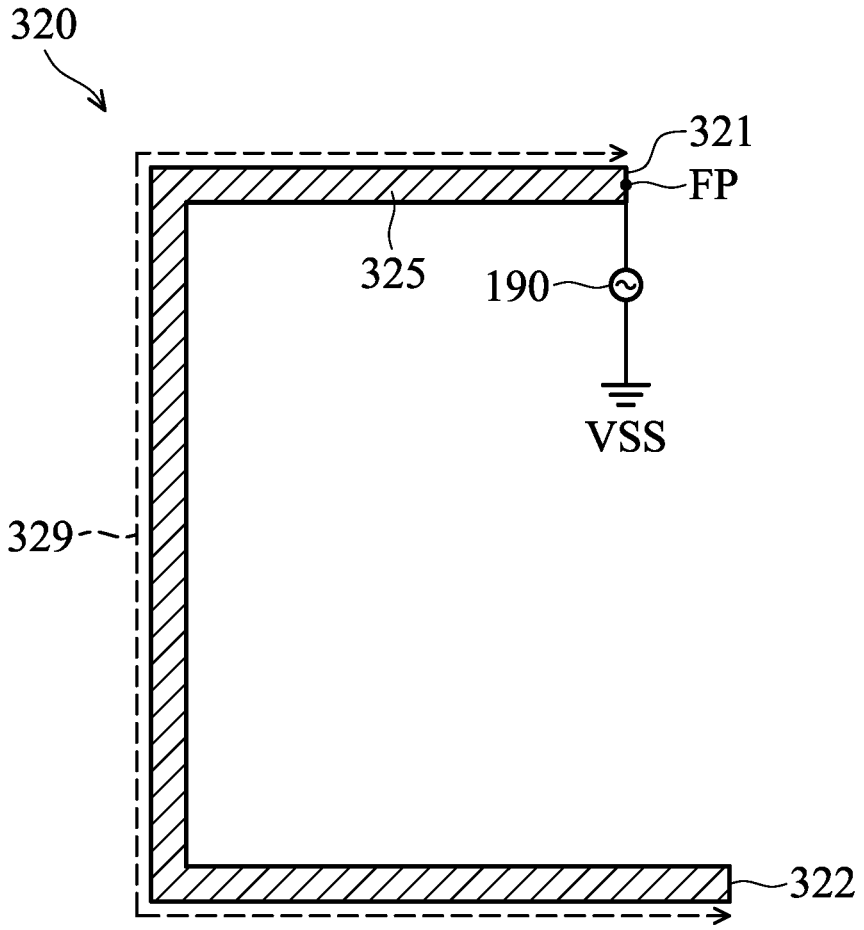
FIG. 3 is a top view of an antenna structure according to an embodiment of the invention.

FIG. 3 is a top view of an antenna structure 320 according to an embodiment of the invention. In the embodiment of FIG. 3, the antenna structure 320 includes a meandering metal line 325. The shape of the meandering metal line 325 is not limited in the invention. For example, the meandering metal line 325 may substantially have a C-shape, an inverted U-shape, or an incomplete loop shape. The meandering metal line 325 has a feeding point FP. The feeding point FP may be positioned at a first end 321 of the meandering metal line 325. A second end 322 of the meandering metal line 325 may be an open end. The feeding point FP may be coupled to a signal source 190, which is arranged for exciting the antenna structure 320. In some embodiments, the feeding point FP of the meandering metal line 325 is coupled through a pogo pin or a metal spring (not shown) to the signal source 190.

Due to the shape characteristics of the meandering metal line 325, the antenna structure 320 has a resonant path 329. The resonant path 329 is the path from the first end 321 to the second end 322 of the meandering metal line 325. With respect to the antenna theory, a low-frequency band of the antenna structure 320 is usually excited and generated by a fundamental resonant mode of the resonant path 329, and a high-frequency band of the antenna structure 320 is usually excited and generated by a higher-order resonant mode of the resonant path 329 (i.e. the double-frequency effect). The length of the resonant path 329 may be substantially equal to 0.25 (λ/4) wavelength of the low-frequency band of the antenna structure 320. Therefore, the designer can appropriately change the length of the meandering metal line 325, so as to control the range of the operation frequency of the antenna structure 320. It should be noted that the meandering metal line 325 of the antenna structure 320 is usually applied to the base 110 made of a nonconductive material. The meandering metal line 325 may be formed on the open side of the base 110 using LDS (Laser Direct Structuring) technology.

The invention proposes a novel wearable device. By incorporating a metal element into the wearable device, it can effectively prevent a user from negatively affecting the radiation performance of an antenna structure thereof. In addition, the metal element is used as an internal element or an appearance decorative element of the wearable device, such that the invention has the advantages of improving both the communication quality and the device appearance.

Note that the above element sizes, element shapes, and frequency ranges are not limitations of the invention. An antenna designer can adjust these settings or values according to different requirements. It should be understood that the wearable device and the antenna structure of the invention are not limited to the configurations of FIGS. 1-3. The invention may merely include any one or more features of any one or more embodiments of FIGS. 1-3. In other words, not all of the features shown in the figures should be implemented in the wearable device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A wearable device worn by a user, comprising:
a base, substantially having a hollow structure;
an antenna structure, disposed on the base;
a ground plane, disposed inside the base; and
a metal element, disposed adjacent to the ground plane, wherein the ground plane is positioned between the antenna structure and the metal element;
wherein the antenna structure is a metal loop;
wherein the antenna structure is excited to generate a low-frequency band from 746 MHz to 787 MHz, and a high-frequency band from 1700 MHz to 2100 MHz;
wherein the antenna structure has a first resonant path and a second resonant path, the first resonant path is a shorter path from a feeding point to a grounding point of the metal loop, and the second resonant path is a longer path from the feeding point to the grounding point of the metal loop; and
wherein a length of the first resonant path is substantially equal to 0.5 wavelength of the high-frequency band, and a length of the second resonant path is substantially equal to 0.5 wavelength of the low-frequency band.

2. The wearable device as claimed in claim 1, wherein the wearable device is implemented with a watch.

3. The wearable device as claimed in claim 1, wherein the base is substantially a box without a lid, and the antenna structure is disposed at an open side of the box.

4. The wearable device as claimed in claim 1, wherein the metal element is a metal plane.

5. The wearable device as claimed in claim 1, wherein the metal element is a metal back cover disposed on a bottom of the base.

6. The wearable device as claimed in claim 1, wherein the metal element is adjacent to the user, so as to prevent the user from interfering with radiation performance of the antenna structure.

7. The wearable device as claimed in claim 1, further comprising:

a transparent element, surrounded by the metal loop.

8. The wearable device as claimed in claim 1, wherein a vertical projection of the ground plane is completely inside the metal loop.

* * * * *